United States Patent [19]

Almeras

[11] Patent Number: 4,877,171

[45] Date of Patent: Oct. 31, 1989

[54] INDIRECT FIRING FASTENER DRIVING APPARATUS WITH FIRING POWER ADJUSTMENT

[75] Inventor: Roland Almeras, Tournon, France

[73] Assignee: Societe De Prospection Et D'Inventions Techniques, Bourg Les Valence, France

[21] Appl. No.: 243,813

[22] Filed: Sep. 14, 1988

[30] Foreign Application Priority Data

Sep. 15, 1987 [FR] France ..... 87 12755

[51] Int. Cl.[4] ..... B25C 1/14; B25C 1/18

[52] U.S. Cl. ..... 227/10; 227/9

[58] Field of Search ..... 227/8-11, 227/142

[56] References Cited

U.S. PATENT DOCUMENTS

| | | | |
|---|---|---|---|
| 3,171,131 | 3/1965 | De Caro et al. | 227/11 X |
| 3,204,400 | 9/1965 | Kvavle | 227/9 X |
| 3,302,840 | 2/1967 | Sekiguchi et al. | 227/8 |
| 3,652,003 | 3/1972 | Leonardo et al. | 227/16 |
| 3,746,235 | 7/1973 | Crabtree, Jr. | 227/9 X |
| 3,918,619 | 11/1975 | Termet | 227/10 X |
| 4,068,790 | 1/1978 | Osterle et al. | 227/10 X |
| 4,113,163 | 9/1978 | Combette et al. | 227/10 |
| 4,358,041 | 11/1982 | Ollivier | 227/9 X |
| 4,374,567 | 2/1983 | Combette et al. | 229/9 X |

*Primary Examiner*—Frank T. Yost
*Assistant Examiner*—James L. Wolfe
*Attorney, Agent, or Firm*—Schwartz & Weinrieb

[57] ABSTRACT

The invention provides an indirect firing fastener driving apparatus with adjustable firing power, including within a barrel holder, a barrel, a piston mounted in frictional contact within the barrel, and a pawl for retaining the piston. A ring, held against rotation in the barrel holder, is screwed onto the barrel. The ring cooperates with a free stop projecting into the barrel so that relative threading of the ring relative to the barrel moves, through means of contact of the stop with the pawl, the position of the piston within the barrel when the barrel is pulled forwardly.

13 Claims, 3 Drawing Sheets

INDIRECT FIRING FASTENER DRIVING APPARATUS WITH FIRING POWER ADJUSTMENT

FIELD OF THE INVENTION

The present invention relates to an indirect firing fastener driving apparatus including, in a barrel holder, a barrel, a piston mounted within frictional contact within the barrel so as to be driven under the action of the combustion gases of a propulsive charge housed within a charge holder fixedly mounted within the barrel and to in turn drive the fastener, a pawl mounted upon the barrel holder and, adapted to project into a groove of the barrel and retain the piston, and means for varying the volume of the combustion chamber, defined between the piston and the charge, and thus the firing power, which includes an adjustment means, mounted upon the barrel thus as to be movable with respect thereto, and means projecting into the barrel and adapted so that movement of the adjustment means with respect to the barrel causes movement of the piston within the barrel.

BACKGROUND OF THE INVENTION

The advantage of a fastener driving apparatus actuated by means of a propulsive charge, comprising powder, is that it is independent and may provide variable driving power of energy.

In order to achieve this objective charges of different powders are often used.

In indirect firing fastener driving apparatus, the power transmitted to the piston may also be varied by varying the volume of the combustion chamber.

An apparatus of the above mentioned type is already known by means of the document FR-A-2 329 415. The apparatus of this document however has some drawbacks. Power adjustment is achieved by means of rotation of the breech. The piston is positioned within the barrel, as a function of the desired power, during abutment of the apparatus so as to place it in the firing position. Such an operation results in a supplemental effort which increases the abutment effort.

Document US-A-3,652,003 also teaches an apparatus of the same type, however, the same also has some drawbacks. Its adjustment means is mounted upon the barrel-holder and is intended to cooperate with a stop fixed upon and projecting out from the barrel. Upon firing with respect to particular materials, the piston may rebound and be driven into the bottom of the barrel. In this case, the adjustment means no longer has any effect upon the position of the piston within the barrel. Upon opening the apparatus, the pawl no longer acts upon the iston, or the relative position of the pawl and the adjustment means is no longer taken into account, and the piston remains at the position of maximum power even though the adjustment means may be at a position of intermediate power. A correct positioning as a function of the desired power cannot therefore always be assured by means of this apparatus.

An apparatus of the above mentioned type is additionally known from the document FR-A-2 218 168. However, it relates to an apparatus with a complex adjustment means. Positioning of the piston is effected upon closing the apparatus, the adjustment means is acted upon by opening the apparatus and closing it, and in addition, such operation also causes the abutment effort to be increased. This adjustment means also comprises a spring which may cause variations of the power adjustment.

OBJECT OF THE INVENTION

The object of the instant invention is thus to obviate the drawbacks of the prior art and to provide a fastener driving apparatus with a power adjustment system which is robust, easy to dismount and exhibits great reliability.

SUMMARY OF THE INVENTION

To this end, the present invention relates to an apparatus of the above mentioned type, characterized in that the adjustment means is mounted within the barrel holder and the projecting means within the barrel includes a stop freely movable in translation, and adapted so that, when the rear side is disposed against the adjustment means, its front side is disposed against the pawl adapted for positioning the piston within the barrel.

Preferably, the adjustment means is mounted within the barrel holder so as to permit the barrel to be rotated with respect to the adjustment means.

Advantageously, the charge holder is provided within the barrel, the adjustment means includes a ring having an inner thread mounted upon the threaded rear part of the barrel and the axial distance separating the surfaces of the stop adapted to bear respectively against the piston and the pawl is substantially equal to the axial distance separating the surfaces of the piston serving as abutment means for the stop and the surface of the piston bearing against the pawl.

BRIEF DESCRIPTION OF THE DRAWINGS

The invention will be better understood from the following description of these preferred embodiments of the apparatus of the invention, with reference to the accompanying drawings in which.

DESCRIPTION OF THE PREFERRED EMBODIMENT OF THE INVENTION

Figure 5:
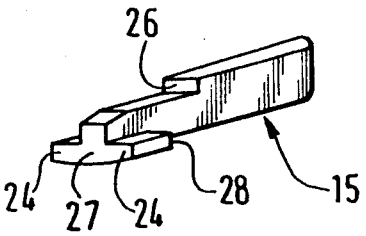
FIG. 5 is a perspective view of the power adjusting stop of the apparatus of the preceding figs.
Figure 3:
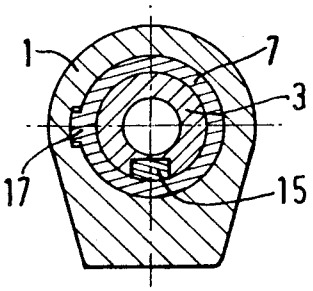
FIG. 3 is a cross sectional view through line III—III of FIG. 2.
Figure 6:
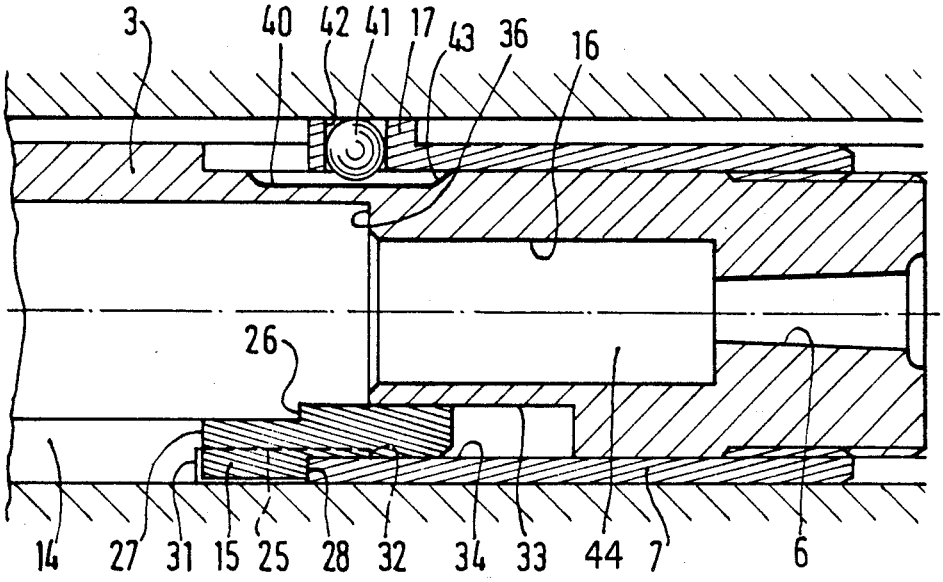
FIG. 6 is an axial sectional view of another embodiment of the power adjustment system of the apparatus, after firing and release of the piston, the power having been adjusted to a minimum level.

The plug, or fastener, sealing, or driving, apparatus, in the embodiment shown in FIGS. 1 to 5, includes a barrel holder 1 with axis 20 in which a loading opening 2 is formed, a barrel 3 mounted for sliding within the barrel holder 1 between a rear position against a breech 4, within which a striker not shown is housed, and a forward opened position. The rear part 5 of the barrel 3 has a bore 6 for receiving the propulsive charge, housed within a charge holder, and is externally threaded so as to mate with a power adjustment ring 7 which is internally threaded. A piston 8, with an enlarged head portion 9 and a rod 10 is mounted in frictional contact within the barrel 3 by means of a retaining ring 11 surrounding the enlarged portion 9 of piston 8. The barrel 3 has a corresponding bore 16, with an annular radial shoulder 36, as seen in FIG. 6, serving as stop for the enlarged portion 9 of piston 8. A plug guide 12 is fixed, for example, by threaded engagement, to the front of barrel 3. A pawl or catch 13 for retaining and repositioning the piston 8 in the firing position is mounted upon the barrel holder 1 and, under the action of return means, projects radially into barrel 3 through means of a groove 14 formed within the barrel 3. A power adjustment stop 15, which will be described in detail further on, is held in position against the adjustment ring 7 and the enlarged portion 9 of piston 8.

The apparatus is intended to propel a plug, not shown, which is introduced by means of the plug guide 12 into a receiving material, by means of piston 8—the apparatus is an indirect firing apparatus—which is intended to be driven forwardly by means of combustion gases of an explosive charge placed within housing 6. Housing 6 and the portion of the inner bore 16 of the barrel 3 extending rearwardly of the piston 8 define the adjustable volume combustion chamber 44, as will now be described.

Figure 4:
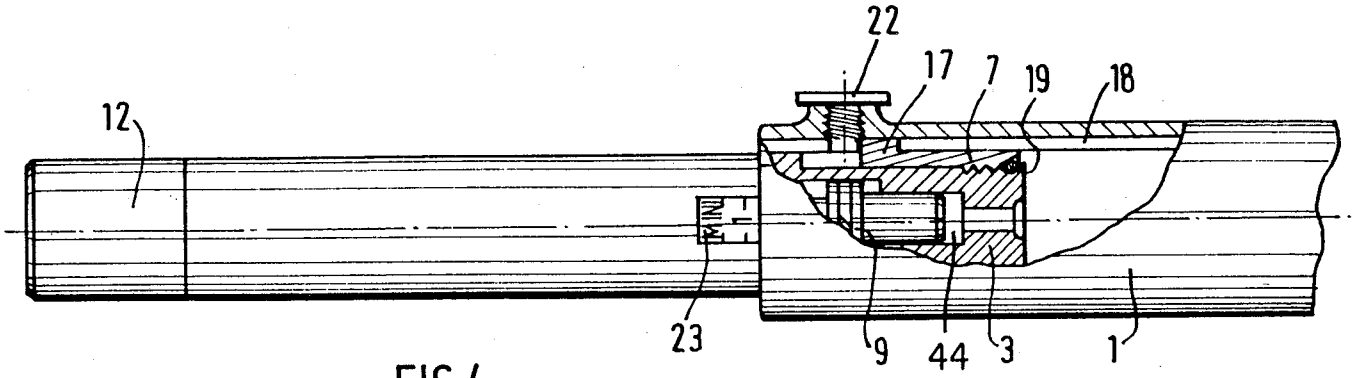
FIG. 4 is a side elevation view of the apparatus of the preceding figs., with parts cut away, showing the check bolt of the adjustment ring in axial section.

This adjustment is achieved by moving ring 7 relative to the rear part 5 of the barrel 3. In actual fact, it is a relative movement, for it is the barrel 3 which must be moved within the ring 7. The ring 7 is in fact held against rotation by means of a boss 17, as shown in FIG. 4, slide within in a groove 18 of the barrel 3 holder 1. The endmost rear position of ring 7 upon the barrel 3 is defined by means of a travel limiting ring 19 mounted upon the rear end of the barrel 3. In order to achieve this position, ring 7 has an inner milling portion 21 defined thereon for coming into abutment against ring 19.

A check bolt 22 is mounted upon the barrel holder 1 so as to pass through the inner bore there of as well as groove 18 and serves as a front stop for boss 17 upon the adjustment ring 7 and thus, when the apparatus is open, bolt 22 prevents the barrel 3, to which ring 7 with its boss 17 is fixed, from accidently separating from the barrel holder 1 when the pawl 13 is retracted.

A scale 23 having power levels noted thereon is fixed to barrel 3 and; it appears upon maximum opening of the apparatus.

Figure 2:
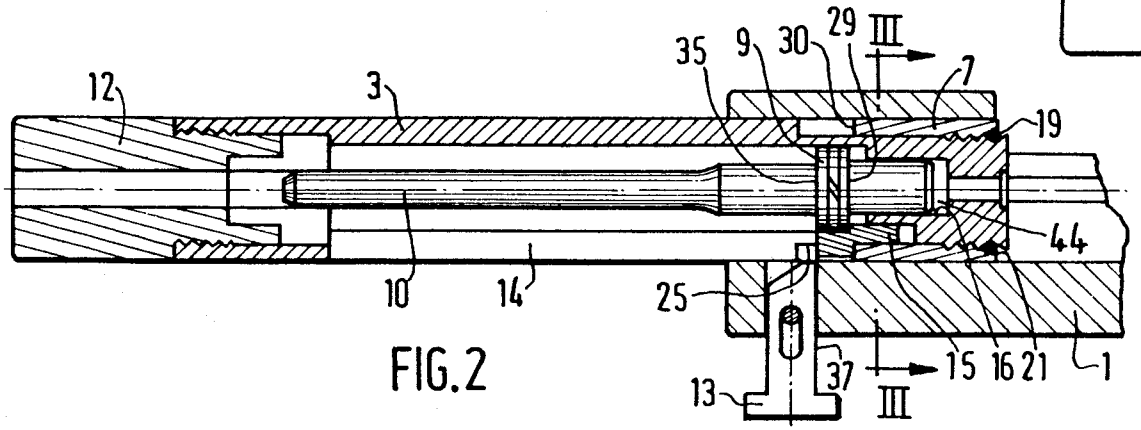
FIG. 2 is an axial sectional view of a portion of the apparatus of FIG. 1, with the barrel still pulled forwardly and the pawl being again retracted and the power having just been adjusted to the lowest level.

The power adjustment stop 15 is a part having a general rectangular shape and is mounted for free axial translation within an extension of the groove 14 for the pawl 13. The stop 15 is axially symmetric such that this part has two lateral lugs 24 (there could have been only a single one) extending between its front face 27 and a rear plane 28 and disposed so as to bear, by means of their upper faces as seen in FIG. 5, upon a flat portion 25 of the barrel 3. Substantially at its central portion part 15 has a shoulder 26. The front face 27 of stop 15 is intended to bear against the pawl 13 when the pawl 13 is disposed at the retained position and with the barrel 3 pulled forwardly; and shoulder 26 may abut against the rear face 29 of the enlarged portion 9 of piston 8; the rear surfaces 28 of lugs 24 are intended to bear against the front annular surface 30 of ring 7 as seen in FIG. 2.

The flat portion 25 of the barrel 3 extends between a front transverse shoulder 31 and a small rear shoulder 32, between which lugs 24 of stop 15 may move freely and which therefore define limits of travel as seen in FIG. 6. To the rear of shoulder 31 a recess 33 is defined within the barrel 3 for accommodating the rear part of stop 15.

Stop 15, rotatably within the apparatus fixed, is held radially in position within barrel 3 by means of the extension of the pawl groove 14 and the inner surface 34 of ring 7 (FIG. 6).

The axial distance separating the surfaces 26 and 27 of stop 15 is slightly greater than the axial distance separating the rear face 29 of the enlarged portion 9 of the piston 8 from its front face 35 which is intended to bear against pawl 13 in the retained position with the barrel 3 pulled forwardly.

With the structure of the different elements forming the apparatus having been now described, its operation and more particularly its power adjustment will now be discussed.

It should first of all be noted that adjustment of the power may take place either with the barrel pulled forwardly or with the apparatus closed, although, in this case, it would be better to speak of variation of the volume of the combustion chamber than adjustment in power, since the scale 23 of the power levels is not visible.

A second remark must be made. When the power is adjusted, with the barrel pulled forwardly, the relative movement of the barrel and of the adjustment ring simultaneously causes the desired positioning of the piston within the barrel under power reduction conditions. If it is a question of increasing the power, it is only after closure and subsequent opening of the apparatus that the piston is correctly positioned. When the power is adjusted, with the apparatus closed, the relative movement of the barrel and the ring does not cause the desired positioning of the piston within the barrel. It is only upon opening the apparatus, which the operator must do before closing it again, that the piston is appropriately positioned.

A third preliminary remark must finally be made. If the piston has not risen, and therefore if the apparatus is closed and the adjustment is being made, the operator must open the apparatus so as to position the piston at the end of the opening operation before closing the apparatus again.

Thus, in all cases, the desired positioning of the piston within the barrel takes place at the end of an opening phase of the apparatus, at the moment when the adjustment stop, when the operator pulls the barrel forwardly, comes into abutment against the pawl.

In order to increase the power, that is to say to reduce the volume of the combustion chamber, pawl 13 is withdrawn from its groove 14 so as to be able to rotate in the unscrewing direction barrel 3 and advance it forwarding within ring 7. In order to reduce the power, the procedure is similar but performed in the opposite direction thereby causing the barrel 3 to move backwardly so as to be threaded into ring 7. With the relative position of barrel 3 and ring 7 axially fixed, pawl 13 is released so as to again project into barrel 3 through groove 14. At the end of the above mentioned positioning phase of the piston 8, the front face 35 of the head of the piston is in abutment against the rear face 37 of the pawl 13, as is the front face 27 of stop 15 against which ring 7 bears. In this position of the elements of the apparatus, there is then a small clearance defined between the rear face 29 of the enlarged portion of the piston head 9 and the shoulder 26 of stop 15. Thus, the relative position 8 of the piston and the barrel 3 is determined by means of the pawl 13, on the one hand, and the stop 15 and the adjustment ring 7 on the other. Upon subsequent closing of the apparatus, this position is not modified because of the ring 11 of the piston head. During such closure, stop 15 remains held between the rear face 29 of the enlarged portion of the head of the piston 8 and the front face 30 of ring 7.

Figure 1:
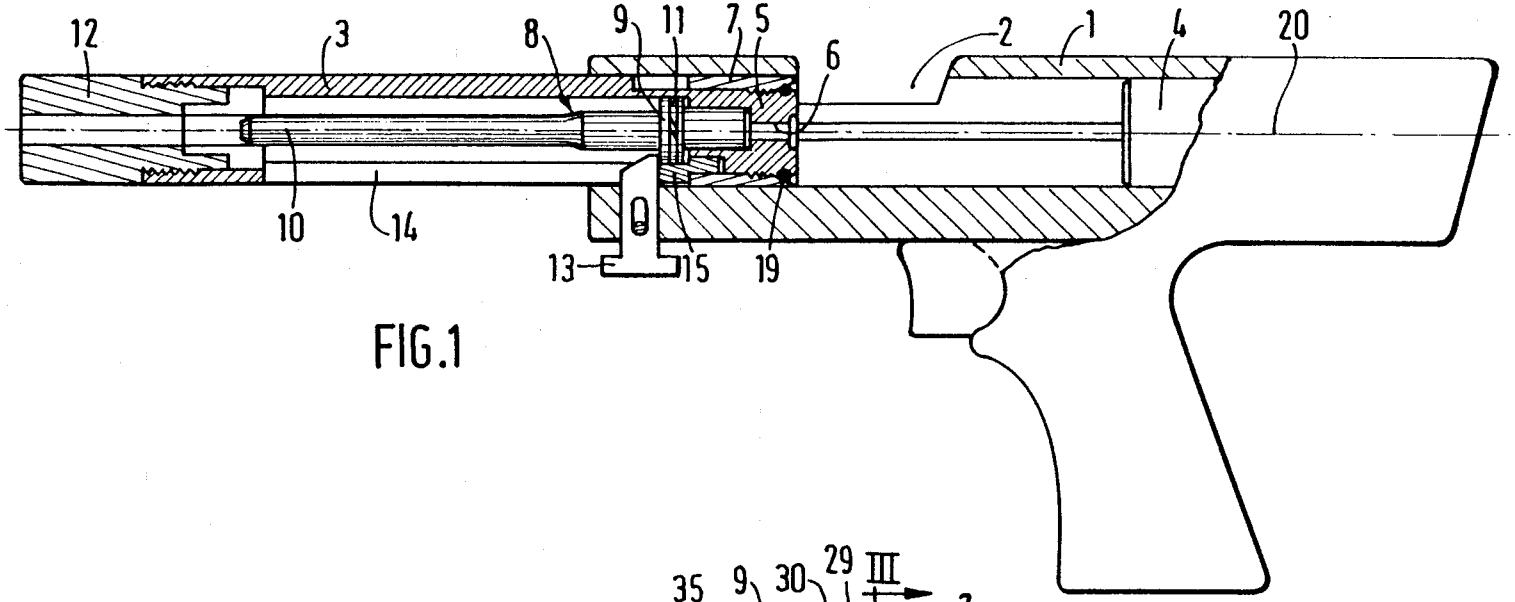
FIG. 1 is an axial sectional view of a first embodiment of the apparatus of the invention, the barrel being drawn forwardly and the power being adjusted to a maximum level.

The adjustment shown in FIG. 1 corresponds to the maximum power level, ring 7 almost abutting at the rear portion thereof the ring 19, or barrel 3 almost abutting at the rear portion thereof, through means of its ring 19, the ring 7. The adjustment shown in FIG. 2 corresponds to a lower power level, and that of FIG. 6 an even lower power level. The minimum power adjustment is obtained by threading barrel 3 into ring 7 until the front face 27 of stop 15, driven axially by means of ring 7 into the endmost front position, comes practically into abutment against the front shoulder 31 of barrel 3 (FIG. 6).

The function of stop 15 thus makes it possible for ring 7, through means of a radial projection, to alter the position of the piston during handling of the barrel by means of the operator, or to transform the rotational movement of the ring with respect to the barrel into a translational movement of the piston.

We saw earlier, for example, that by unscrewing the barrel relative to the ring 7 the power was increased. Of course, if the direction of the threads upon the barrel and the adjustment ring were reversed, the rotation of the barrel causing the power variation would also be reversed.

It will be noted that the form of stop 15 has been designated, should the barrel be suddenly opened, so as to reduce as much as possible the risks of breakage; thus has substantial contact surfaces with pawl 13 and the adjustment ring 7 and thus works well under compression conditions between the pieces.

Barrel 3 and the adjustment ring 7 of FIG. 6, almost identical to those of the preceding Figs., are distinguished by the single fact that ring 19 upon the barrel 3 and the milling 21 formed upon ring 7, forming the end of travel means, have been replaced respectively by means of a groove 40, formed within the barrel, receiving a ball 41 housed in a bore 42 of boss 17 of the ring 7 and intended to cooperate with the rear edge 43 of groove 40 so as to prevent complete unscrewing of the barrel beyond its maximum power position.

Figure 7:
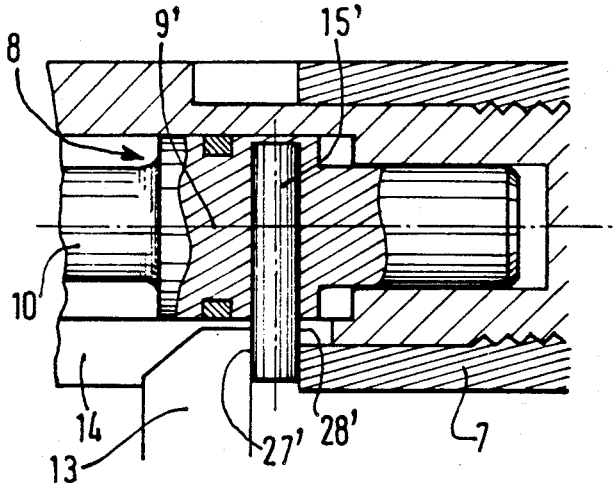
FIG. 7, is an axial sectional view of the power adjustment system of a third embodiment of the apparatus of the invention.

The adjustment system of the apparatus shown in FIG. 7 is distinguished from that of the apparatus shown in FIGS. 1 to 6 by the fact that the stop comprises a pin 15' driven radially into the piston head 9' adapted accordingly, the other parts of the apparatus being identical to those of the previously described apparatus. Apart from the fact that the piston head 9' no longer has to cooperate directly with pawl 13, but through means of pin 15' fixed within the head, the operation of this latter apparatus remains identical to that of the apparatus shown in FIGS. 1 to 6. Thus, positioning of the piston for determining the volume of the combustion chamber is achieved, after positioning the ring 7 relative to barrel 3, where pin 15' is in contact by means of its two opposite radial faces 27' and 28'' with pawl 13 and ring 7, respectively.

Obviously, many modifications and variations of the present invention are possible in light of the above teachings. It is therefore to be understood that within the scope of the appended claims, the present invention may be practiced otherwise than as specifically described herein.

I claim:

1. An indirect firing fastener driving apparatus, comprising:

a barrel holder;

a barrel movable within said barrel holder between a rearward position and a forward position;

propulsive charge means mounted within said barrel for generating combustion gases when a fastener driving operation is to be performed;

a piston mounted in frictional contact within said barrel so as to be driven by said combustion gases and to in turn drive said fastener;

a pawl mounted upon said barrel holder so as to project through a groove, defined within said barrel, and engage said piston so as to retain said piston in a fired position;

a combustion chamber defined between said piston and said propulsive charge means; and means for varying the volume of said combustion chamber comprising adjustment means mounted upon said barrel so as to be movably adjustable with respect to said barrel, and stop means operatively engaged with said piston and having a front end and a rear end, wherein said rear end is in contact with said adjustment means, and when said barrel is disposed in said forward position, said front end of said stop means is in contact with said pawl so as to position said piston within said barrel in accordance with said movable adjustment of said adjustment means with respect to said barrel.

2. Apparatus according to claim 1, wherein:

said adjustment means is mounted so as to be rotatable relative to said barrel.

3. Apparatus according to claim 1, wherein:

said stop means is mounted within an extension of said groove defined within said barrel and through which said pawl extends so as to engage said piston.

4. Apparatus according to claim 1, wherein:

said stop means comprises a pin fixedly mounted within said piston.

5. Apparatus according to claim 1, wherein said stop means comprises:

at least one lug extending between a front face, for abutment with said pawl, and a rear face for abutment with said adjustment means; and a shoulder portion for abutment with said piston.

6. Apparatus according to claim 5, wherein:

said piston comprises a head, having an enlarged portion, which includes a front face for engagement with said pawl, and a rear face for engagement with said stop means, and wherein further the distance defined between said front face of said lug of said stop means and said shoulder of said stop means is substantially equal to the distance defined between said front and rear faces of said piston head.

7. Apparatus according to claim 1, wherein:

said barrel holder includes check bolt means for engaging said adjustment means so as to retain said adjustment means and said barrel within said barrel holder.

8. Apparatus according to claim 1, wherein:

means are provided for limiting the rearward movement of said adjustment means relative to and beyond said barrel.

9. Apparatus as set forth in claim 8, wherein said limiting means comprises:

a stop ring fixedly mounted upon a rear end portion of said barrel for engaging a rear end portion of said adjustment means.

10. Apparatus as set forth in claim 8, wherein said limiting means comprises:

groove means defined within said barrel; and ball means disposed within said adjustment means and engageable within said groove means defined within said barrel for engaging a rear portion of said groove means of said barrel.

11. Apparatus according to claim 1, wherein:

said adjustment means comprises a threaded ring threadably mounted upon a threaded portion of said barrel.

12. Apparatus according to claim 1, further comprising:

groove means defined within said barrel holder; and boss means provided upon said adjustment means for engagement with said groove means of said barrel holder whereby rotation of said adjustment means with respect to said barrel holder is prevented.

13. Apparatus as set forth in claim 1, further comprising:

indicia means mounted upon said barrel for indicating variable firing power levels of said apparatus as a function of the variance of said volume of said combustion chamber.

* * * * *